US008425248B2

(12) United States Patent
Ohsako

(10) Patent No.: US 8,425,248 B2
(45) Date of Patent: Apr. 23, 2013

(54) PLUG ELECTRICAL CONNECTOR WITH ELASTIC LATCH

(75) Inventor: Tetsutaro Ohsako, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 261 days.

(21) Appl. No.: 12/954,132

(22) Filed: Nov. 24, 2010

(65) Prior Publication Data

US 2011/0143570 A1 Jun. 16, 2011

(30) Foreign Application Priority Data

Dec. 10, 2009 (JP) ..... 2009-280299

(51) Int. Cl.
*H01R 13/648* (2006.01)

(52) U.S. Cl.
USPC ..... 439/353

(58) Field of Classification Search ..... 439/353, 439/357, 358
See application file for complete search history.

(56) References Cited

U.S. PATENT DOCUMENTS

| | | | | |
|---|---|---|---|---|
| 6,116,938 | A * | 9/2000 | Myer et al. | 439/353 |
| 6,296,508 | B1 * | 10/2001 | Kuwahara et al. | 439/353 |
| 6,332,799 | B1 * | 12/2001 | Torii et al. | 439/352 |
| 6,676,433 | B1 * | 1/2004 | Ozaki | 439/353 |
| 6,902,438 | B2 * | 6/2005 | Tsuyama | 439/694 |
| 7,311,557 | B2 * | 12/2007 | Oma et al. | 439/660 |
| 7,371,115 | B1 * | 5/2008 | Hsieh et al. | 439/587 |
| 7,500,864 | B2 * | 3/2009 | Mase et al. | 439/352 |
| 8,052,458 | B2 * | 11/2011 | Rossman et al. | 439/358 |

FOREIGN PATENT DOCUMENTS

| | | | |
|---|---|---|---|
| JP | 10-199621 | * | 7/1998 |
| JP | 10-199621 | A | 7/1998 |
| JP | 2002-203635 | * | 7/2002 |
| JP | 2002-343501 | A | 11/2002 |
| JP | 2002-2343501 | * | 11/2002 |
| JP | 2006-269141 | A | 10/2006 |
| JP | 2006-269406 | * | 10/2006 |
| JP | 2008-66030 | * | 3/2008 |
| JP | 2008-066030 | A | 3/2008 |

* cited by examiner

*Primary Examiner* — Neil Abrams
(74) *Attorney, Agent, or Firm* — Kubotera & Associates, LLC

(57) ABSTRACT

A plug electrical connector includes a housing having a front face section and a back face section, and the housing has an elastic arm. The elastic arm has a locking section for locking to a receptacle connector. A pressing section is formed on the back face section. The elastic arm further has a slanted section, and the slanted section has an operating section for receiving an operative force. The housing has a front face protrusion. The front face protrusion has a protruding top portion situated at a position the same as that of the slanted section or protruding further than the slanted section in a front-to-back direction.

10 Claims, 3 Drawing Sheets

PLUG ELECTRICAL CONNECTOR WITH ELASTIC LATCH

BACKGROUND TECHNOLOGY AND RELATED TECHNOLOGY

The present invention relates to a plug electrical connector having an elastic arm in a housing thereof, in which the elastic arm has a locking section to mutually lock to a receptacle connector as a mating connector thereof when the plug electrical connector is fitted to the receptacle connector.

Patent Reference has disclosed a conventional plug connector. The conventional plug connector is connected to a cable such that the cable extends in an orthogonal direction to a fitting direction with respect to a mating connector, i.e., a receptacle connector. The conventional plug connector has elastic arms, which extend from side faces of a housing on both sides of the cable in the fitting direction to the receptacle connector. The elastic arm has a protruding locking section, and can be elastically flexed toward the side faces of the housing when the elastic arm receives an operative force.

Patent Reference: Japanese Patent Publication No. 2006-269141

When the conventional plug connector disclosed in Patent Reference is fitted to the receptacle connector, and the plug connector is pressed in the fitting direction, the locking section abuts against a corresponding locking section of the receptacle connector to receive a reaction force. With the reaction force, the elastic arm elastically deforms, so that the locking section can further move in the fitting direction.

When the locking section moves over and passes the corresponding locking section, the elastic arm is released elastic deformation and the locking section is locked to the corresponding locking section. Accordingly, it is possible to confirm the locking through a clicking feeling. When the conventional plug connector is disconnected from the receptacle connector, the operative force is applied onto the elastic arm, so that the elastic arm elastically deforms. Accordingly, the locking section is released from the corresponding locking section and the plug connector is pulled out.

As described above, when the conventional plug connector disclosed in Patent Reference is fitted to the receptacle connector, the elastic arm elastically deforms at the locking section with the reaction force from the corresponding locking section. Immediately when the locking section rides over and passes the corresponding locking section, the elastic flexion is automatically released, thereby obtaining the clicking feeling from to confirm the locking.

However, in some cases, an operator may try to connect the conventional plug connector to the receptacle connector while holding the plug connector at a portion of the elastic arm. More specifically, the operative force may be applied to the elastic arm before and after connecting the conventional plug connector to the receptacle connector, so that the elastic arm is in the elastically deformed state. Accordingly, even after the locking section passes over the corresponding locking section, the elastic arm is still in the elastically deformed state by the operative force.

In this case, only after the operator confirms the locking, the operative force is released. In comparison with a regular operation, in which the elastic arm is released from the locking state to a free state only through the reaction force from the corresponding locking section without the operator touching the elastic arm, the operative force is not quickly released. Therefore, it may be difficult to obtain the clicking feeling at the moment of the locking, or possible to obtain only insufficient clicking feeling.

In view of the above problems, an object of the present invention is to provide a plug electrical connector capable of generating a sufficient clocking feeling when the plug electrical connector is connected to a mating connector.

Further objects and advantages of the invention will be apparent from the following description of the invention.

SUMMARY OF THE INVENTION

In order to attain the objects described above, according to a first aspect of the present invention, a plug electrical connector includes a housing having a front face section and a back face section, which respectively extend in a fitting direction and face to each other. In the plug electrical connector, the housing has an elastic arm, which extends frontward, i.e., toward a receptacle connector, from a rear portion of the front face section and has a front end as a free end.

In the first aspect of the present invention, the elastic arm has a locking section for locking to the receptacle connector. A pressing section is formed on the back face section. When an operative force is applied to the elastic arm and the pressing section, the elastic arm elastically deforms toward the back face section, so that the locking section is released from the receptacle connector.

According to the first aspect of the present invention, the elastic arm has a slanted section, which tilts frontward away from the front face section, and the slanted section has an operating section at a front section thereof for receiving the operative force. The housing has a front face protrusion, which protrudes from the front face section in a direction that the elastic arm deforms elastically and is situated on both sides of the elastic arm at a rear section of the front face section in a front-to-back direction. The front face protrusion has a protruding top portion situated at a position the same as that of the slanted section or protruding further than the slanted section in the front-to-back direction.

In the first aspect of the present invention, when the plug connector is connected to the receptacle connector, an operator easily pinch with fingers a rear section of the plug connector in the fitting direction, which is close and visible to the operator. In the plug connector of the invention, the elastic arm is provided with the slanted section for releasing the plug connector from the receptacle connector, and the front face protrusion is disposed on the both sides of the elastic arm at the rear section of the front face section of the plug connector. Furthermore, the front face protrusion has the protruding top portion situated at the position the same as that of the slanted section or protruding further than the slanted section in the front-to-back direction.

Accordingly, when the operator pinches the rear sections of the front face section and the back face section with fingers for fitting the plug connector to the receptacle connector, only the front face protrusion is pressed and the slanted section of the elastic arm is pressed. In other words, the elastic arm is fitted without being elastically deformed. Only when the locking section abuts against the corresponding portion of the receptacle connector, i.e. the mating connector, the elastic arm is elastically deformed through the reaction force. Once the locking section rides over and passes the corresponding portion, the elastic deformation of the elastic arm is released. At this time, the elastic arm is pressed with the finger, so that the elastic deformation is quickly released, thereby obtaining sufficient clicking feeling.

In the first aspect of the present invention, when the plug connector is disconnected from the receptacle connector, it is necessary for the operator to press the elastic arm with the finger so as to release the locking. When the plug connector is disconnected from the receptacle connector, the operator does not need to pinch the rear section, which is the easiest portion to pinch. The elastic arm has the operating section formed on the front part thereof, and the front face protrusion is not situated on a side of the operating section. Accordingly, the operator can easily pinch the plug connector at the operating section and the back face section, so that the elastic arm is elastically deformed to disconnect the plug connector from the receptacle connector.

According to a second aspect of the present invention, the operating section of the elastic arm is preferably situated at the same position or protrudes further than the protruding top portion of the front face protrusion in the direction that the front face protrusion protrudes. As described above, the front face protrusion is not situated on the side of the operating section at the position that corresponds to the operating section in the front-to-back direction. When the operating section protrudes a large extent, the operation becomes easier, especially when the operating section of the elastic arm is situated at the same position or protrudes further than the protruding top portion of the front face protrusion.

According to a third aspect of the present invention, preferably, the housing has a back face protrusion, which protrudes from the back face section thereof at a rear portion of the back face section, and the back face protrusion has a pressing section. With the back face protrusion, when the operator pinches the plug connector with fingers, the finger is easily placed on the back face protrusion to press the back face section. Accordingly, it is possible to easily and securely operate.

According to a fourth aspect of the present invention, the back face protrusion is preferably provided at a position so as to overlap with the front face protrusion in the front-to-back direction. With the configuration, when the plug connector is connected to the receptacle connector the operator pinches the front face protrusion and the back face protrusion at substantially same positions, thereby making it possible to easily and securely operate.

According to a fifth aspect of the present invention, the front face protrusion is preferably curved near the protruding top portion thereof toward the elastic arm. When the front face protrusion is curved in this way, the protruding top portion of the front protrusion is situated close to the elastic arm. Accordingly, when the operator presses the protruding top portion with the fingers to fit the plug connector to the receptacle connector, the finger does not likely press the elastic arm.

According to a sixth aspect of the present invention, the front protrusion and the back face protrusion have push-in faces on rear surfaces thereof for receiving a press-in force applied in the fitting direction when the plug connector is connected to the receptacle connector. When the front protrusion and the back face protrusion have the press-in faces, it is possible to easily apply the press-in force in the fitting direction toward the receptacle connector. Further, it is possible to effectively apply the press-in force without pressing other portions.

As described above, according to the invention, the rear part of the housing, which provides the easiest section to pinch the plug connector, has the front face protrusions that protrude on the both sides of the elastic arm than the rear part of the elastic arm.

Accordingly, even if the operator pinches the housing at the front face section and the back face section upon fitting, the operator only presses the front protrusions, and the elastic arm does not receive the force and is not elastically deformed. When the locking section abuts against the corresponding locking section, the locking section receives the reaction force from the corresponding section and elastically deforms. Then, right after the locking section moves over and passes the corresponding locking section, the locking section is suddenly released from the elastic deformation, thereby securely generating the sufficient clicking feeling.

DETAILED DESCRIPTION OF THE PREFERRED EMBODIMENTS

Hereunder, embodiments of the invention will be described with reference to the accompanying drawings.

First Embodiment

Figure 1:
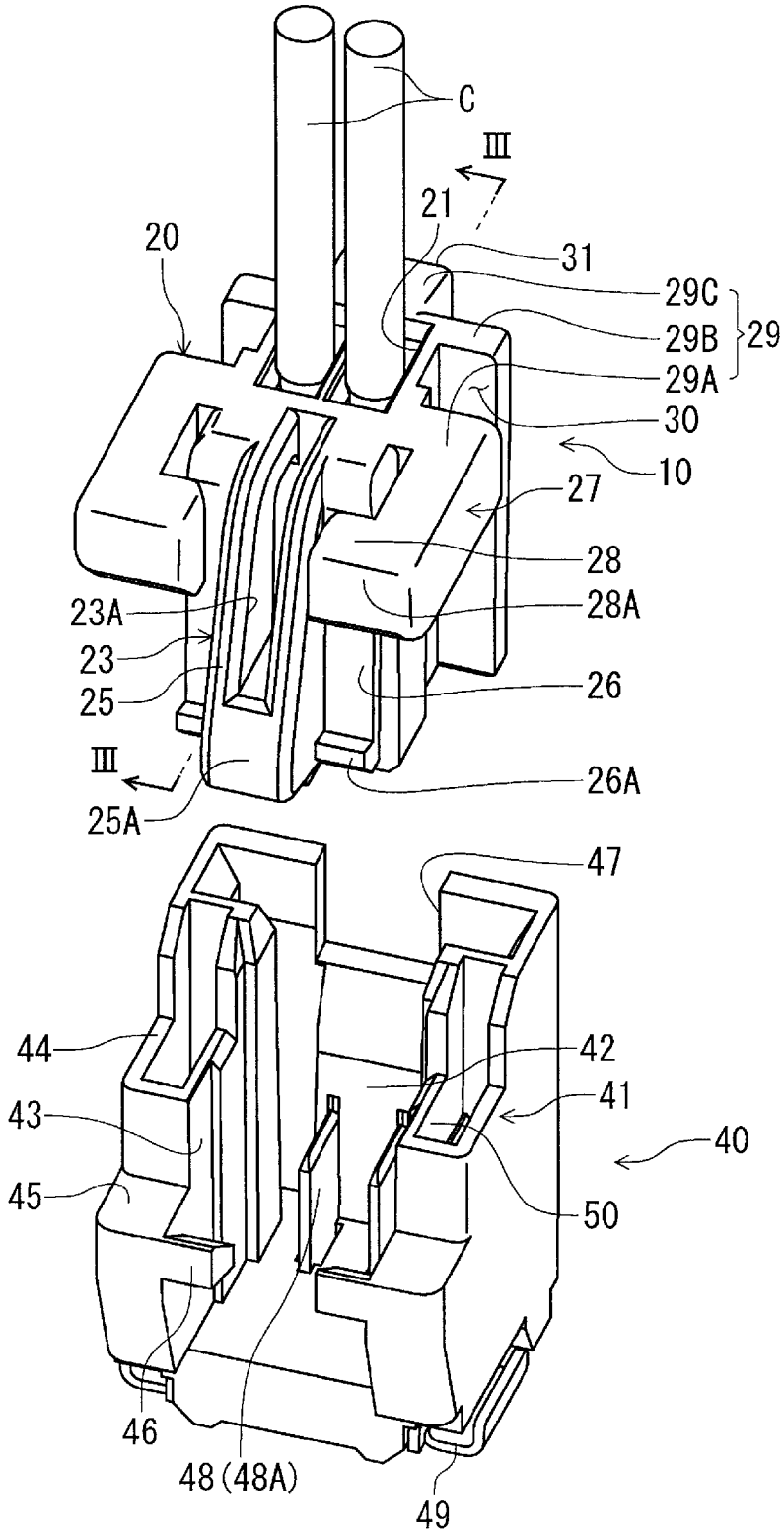
FIG. 1 is a perspective view showing a plug connector and a receptacle connector according to an embodiment of the present invention.

A first embodiment of the present invention will be explained. FIG. 1 is a perspective view of a plug connector 10 of the invention before the plug connector 10 is fitted to a mating connector and a receptacle connector 40 as the mating connector, which is viewed from the front side and rear face side (upper side).

Figure 2:
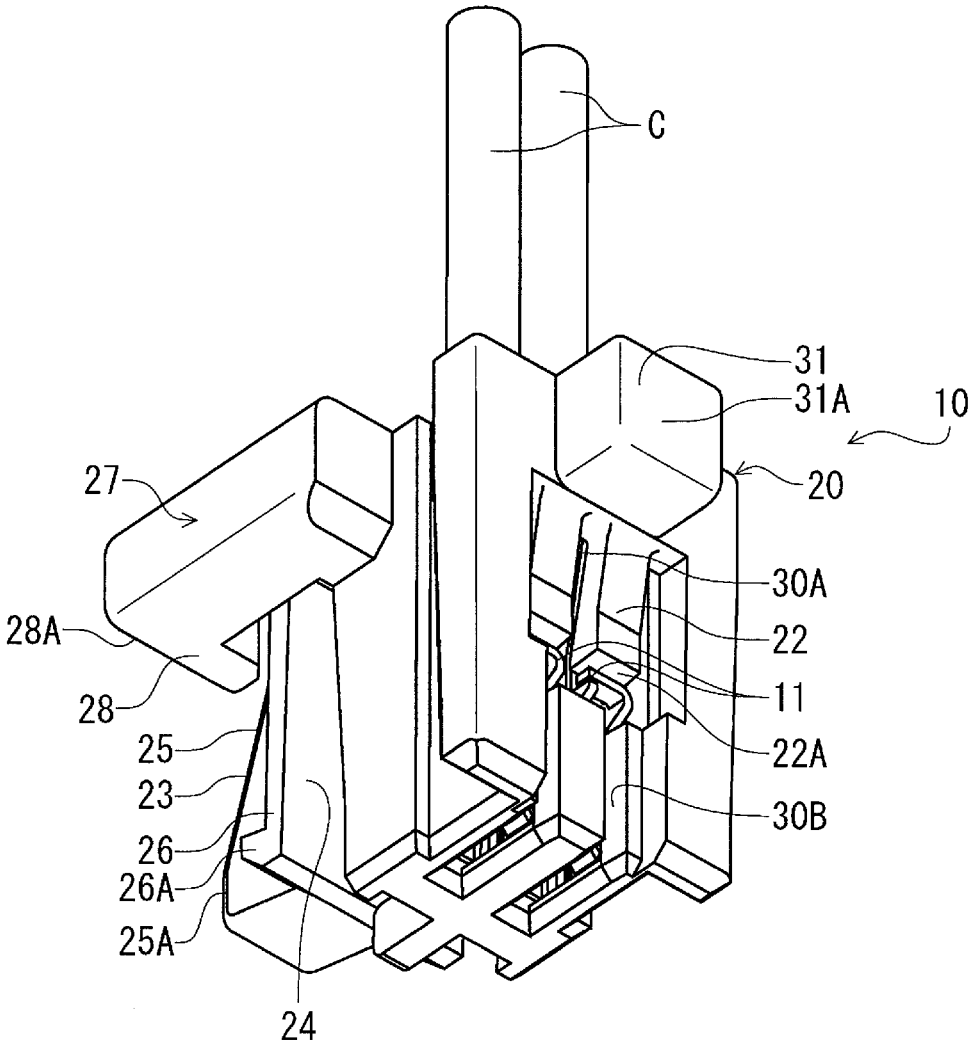
FIG. 2 is a perspective view showing the plug connector shown in FIG. 1 viewed from a back face side and a front face side thereof according to the embodiment of the present invention.
Figure 3:
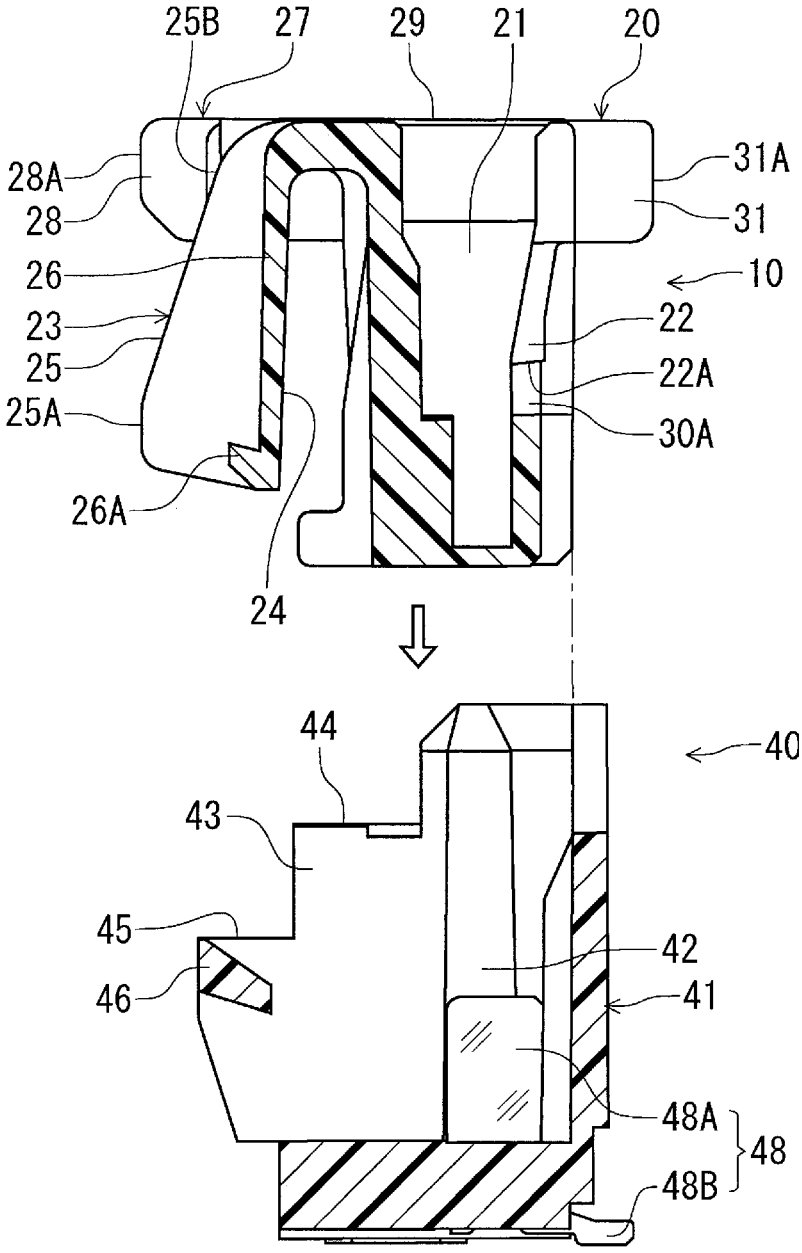
FIG. 3 is a sectional view showing the plug connector and the receptacle connector shown in FIG. 1 taken along a line III-III in FIG. 1 according to the embodiment of the present invention.

FIG. 2 is a perspective view of the plug connector 10 of FIG. 1, which is viewed from the back face side and the front side (lower face side). FIG. 3 is a sectional view of the both connectors 10 and 40 of FIG. 1 before fitting, which are taken along line III-III of FIG. 1. In FIGS. 1 to 3, a terminal with a cable is omitted in the plug connector 10. Further, in FIGS. 1 to 3, the lower side in the fitting direction is set as a front side and the upper side is set as a rear side.

As shown in the figures, in the plug connector 10, terminals 11 connected to cables C are inserted into terminals holes 21, which are opened at the rear face of the housing 20 and extend toward the front side. In the embodiment, there are two terminal holes 21, and the terminals 11 are inserted into the terminals holes 21, and the cables C extends out toward the rear side (in the upper direction).

In the embodiment, the housing 20 is made of an electrically insulating material, has outer appearance of generally rectangular prism, and has protruding sections in part. As shown in FIG. 3, the housing 20 has a lance 22 that extends toward the front side, being formed by partially cutting to a U-shape, on the back face section side (on the right side in FIG. 3) of the terminals 21, which is opened at the rear side and extends to near the front wall (bottom wall). The lance 22 locks to a part of the terminal 11 at its end 22A, and thereby prevents the terminal 11 (the terminal 11 is omitted in FIG. 3) from coming off therefrom (see FIG. 2).

In the embodiment, the housing 20 has an elastic arm 23, which has a basal portion at the back portion of the front face section and extends frontward, on the front face side that is opposite the back face side. The elastic arm 23 has slanted faces 25, whose respective inner faces 24 (the face on the right side of the elastic arm 23 in FIG. 3) extends substantially vertically and whose outer faces (the face on the left side of the elastic arm 23 in FIG. 3) that extends while protruding gradually leftward more as it is closer to the front.

As shown in FIG. 1, the elastic arm 23 has a mortise 23A from the rear end to almost the front end so that the center part is opened in the width direction from the inner to the outer faces, so as to be able to easily elastically flex over the whole length. The front end section is not mortised and forms an operating section 25A having a flat surface on the slanted face 25.

In the embodiment, the elastic arm 23 has protruded longitudinal sections 26, each of which extends from the rear end to the front end, on the both sides at the edge on the back face section side, and has a hook-like locking section 26A on the outer face side of the front end.

In addition, the housing 20 has protruding arms 27, each of which protrudes toward front face (in the left lower direction in FIG. 1) from the both sides of the basal section of the elastic arm 23. Each protruding arm 27 is made to have high rigidity, and has its ends in the protruding direction (leftward in FIG. 3) bent to an L-shape toward the elastic arm 23 (see FIGS. 1 and 2). Each end portion forms a front face protrusion 28, which is to be one of the portions for pinching the plug connector 10 upon fitting the plug connector 10.

In the embodiment, the protruding top portion 28A, which is a face of the most protruding portion of the front face protrusion 28, works as a face to be pressed with one finger upon pinching the plug connector 10. In order to secure the function, the protruding top portion 28A is positioned to protrude more leftward in FIG. 3 than a portion 25B of the slanted face section 25 of the elastic arm 23, which corresponds to the protruding top portion 28A in the front-to-back direction.

A face, where the protruding top portion 28A on the both sides of the elastic arm 23 faces a side face of the elastic arm 23, is supposed not to contact with the elastic arm 23 at any time, forming space from the elastic arm 23, and is preferably provided close to the elastic arm 23 as much as possible.

While the operating section 25A formed at the front end of the slanted face 25 of the elastic arm 23 (the operating section 25A is less tilted than the portion therebehind), is provided more front than the protruding top portions 28A in the front-to-back direction and at the almost same position as the protruding top portion 28A in the left-and-right direction in FIG. 3, it can protrude slightly more leftward.

In the embodiment, the protruding arm 27, which forms the front face protrusion 28, forms a flat surface on the rear face (upper face in the figure), and forms a portion 29A of a press-in face 29 to press the plug connector 10 in the fitting direction, upon fitting connectors.

In the embodiment, the housing 20 has on its back face projecting sections 30, each of which extends in the front-to-back direction and project in the width direction. An upper face of each projecting section 30 forms another portion of the press-in face 29.

Furthermore, as obvious from FIG. 2, the housing 20 has a notched groove 30A to form the lances 22, and terminal grooves 30B to allow a contact section 48A of each flat terminal 48 of the mating connector, i.e. receptacle connector, which will be described later, to enter therein, is formed to connect to the notched groove 30A of the lance and to open downward. Since the strength of the housing could be weakened by the configuration (see FIG. 2), the projecting section 30 is also for securing the strength of the wall section on the back face side of the housing.

Moreover, the housing 20 has a back face protrusion 31, which protrudes from the rear section of the back face. The back face protrusion 31 has a pressing section 31, which forms a face to be pressed with another finger upon pinching the plug connector 10, to work with the protruding top portion 28A of the aforementioned front face protrusion 28 pressed by one finger (see FIG. 2).

In the embodiment, the back face protrusion 31 has an upper face continuously formed at the same level as the upper face of the projecting sections 30, and forms another portion 29C of the press-in face 29 similarly to the upper face of the projecting face 30 (see FIG. 1). The back face protrusion 31 is preferably provided at the same level as the front face protrusion 28 in the front-to-back direction, but may not be limited to the level and may be at any position as long as the back face protrusion 31 is formed having overlapping area with the front face protrusion 28 in the direction.

On the other hand, the receptacle connector 40 to fit the above-described plug connector 10 therein has a housing 41, which forms a receiving recess 42 to receive the plug connector 10 and terminals 48 held by the housing 41, which will be described later.

In the embodiment, the housing 41 is made of an electrically insulating material, and is configured such that the protruding arms 27 and an operating section 25A, which is a front end section of and the elastic arm 23, on the front face side, and a pressing section 31A of the back face protrusion 31A on the back face side are to be respectively exposed outside the housing 41 when the plug connector is fit in the receiving recess 42.

In the embodiment, the receiving recess 42 of the housing 41 is opened on the front face side via the opening 43, and the opening 43 is also opened on the rear side (upward). In case of the housing 41, area of the front face side, which corresponds to the protruding arm 27 of the plug connector 10, is formed to be step-like structure with its upper face lower, which includes a first step section 44 and a section step section 45 that is lower than the first step section 44. The step height of the first step section 44 is almost the same as the longitudinal dimension of the protruding arm and is configured to hold the basal part side of the protruding arm 27.

In the embodiment, the second step section 45, which is lower than the first step section 44, is provided certain space away from the front face protrusion 28, which is a tip side of the protruding arm 27. With the space, it is possible to easily press without affecting on the pressing the protruding top portion 28A with finger, which is a face of the front face protrusion 28.

At a position, which corresponds to the second step section 45 in the front-to-back direction, there is locking arms 46, which will approach each other, on the two facing inner faces of the opening 43.

As shown in FIG. 3, the rear face (upper face) and the front face (lower face) of the locking arm 46 are both slanted to direct inward and downward of the opening 43, and upon fitting the plug connector 10 to the receptacle connector 40, the rear face guides the locking section 26A of the plug connector 10, and right after the fitting, the front face securely locks to the locking section 26A. Upon completion of fitting, the operating section 25A formed on the front part of the elastic arm 23 of the plug connector 10 is positioned in front of (under) the locking arm 46, and protrudes much more than the front face of the receptacle connector 40.

On the side walls of the back face of the housing 41 of the receptacle connector 40, a recess 47 that is opened on the back side is formed. Upon fitting of the plug connector 10, the recess 47 receives the back face protrusion 31 of the plug connector 10 in the front-to-back direction, and the back face protrusion 31 significantly protrudes on the back face side.

In the embodiment, the housing 41 has terminals 48. The terminal 48 is made punching sheet metal and has a contact section 48A which is flat inside the receiving recess 42 of the housing 41 and a connecting section 48B for connecting to a circuit board, which protrudes from the bottom face of the housing 41 and is bent in the lateral direction (see FIG. 3). The contact section 48A enters the terminal groove 30B of the plug connector 10, and contacts with a terminal 11 having elasticity of the plug connector 10. In addition, on each side wall of the housing 41, there is a through hole 50 in the front-to-back direction. In each hole 50, there is provided a mounting piece 49 so as to be able to mount the housing 41 onto a substrate by soldering.

From now on, how to use and working principle of the plug connector of the embodiment will be described.

(1) First, bring the plug connector 10, onto which a terminal with a cable is inserted, above the receptacle connector 40 as shown in FIGS. 1 and 3, which is already mounted on a circuit board (not illustrated). Thereafter, move the plug connector 10 straight down thereto, to start fitting to the receiving recess 42 of the receptacle connector 40. At this time, the operator of the fitting pinches the plug connector 10 with his/her two fingers, and tightly presses a face of the protruding top portion 28A of the front face protrusion 28 with one finger and a face of the pressing face 31A of the back face protrusion 31 with another finger.

Similarly to the back face protrusion 31, the front face protrusion 28 is located in the easiest position to pinch for the operator, being at the rear end section, i.e. most upper position, of the plug connector 10. Accordingly, upon fitting, the operator pinches the front face protrusion 28 and the back face protrusion 31, and the operator put one finger on the front face protrusion 28 without touching the elastic arm 23.

Even if the operator also touches the elastic arm 23 at the same time as he touches the front face protrusion 28, since his/her finger hardly exerts pressing force onto the elastic arm 23 being restricted by the protruding top portion 28A of the front face protrusion 28, the elastic arm 23 does not elastically deforms and maintains its original free state.

(2) In such state, the plug connector 10 enters the receiving recess 42 without problems until the locking section 26A abuts to the locking arm 46 of the receptacle connector 40.

(3) Until the locking section 26A of the plug connector 10 touches the locking arm 46 of the receptacle connector 40, the operator's fingers do not touch the elastic arm 23, and even if he/she also touches the front face protrusion 28, since the elastic arm 23 does not receive any pressing force due to the above-described reason, the elastic arm is not elastically deformed at all.

After the contacting, the operator applies press-in force onto the pressing face 29, which is a rear face of the plug connector 10, with his/her finger forward (downward). Receiving the press-in force, the elastic arm 23 of the plug connector 10 finally starts to elastically flex to deform receiving the reaction force from the locking arm 46, and the locking section 26A moves over the locking arm 46 and passes the locking arm 46.

Once the locking section 26A passes the locking arm 46, there is no reaction force anymore from the locking arm 46, the elastic arm 23 suddenly recovers from its elastic deformation to the original shape, and thereby the protruding section 26 collides to the locking arm 46. At this moment, the operator can have clicking feeling of secure locking. The plug connector 10 and the receptacle connector 40 lock to each other in this way, and thereby are prevented from coming off from each other.

(4) When the operator wants to pull out the plug connector 10 from the receptacle connector 40, the operator puts one finger on the operating section 25A, which is located in front of the front face protrusion 28, and another finger on the pressing section 31A of the back face protrusion 31. Since the operator puts one finger on the operating section 25A with intention of pulling out of the plug connector 10, even if the operating section 25A is in a position away from the pressing section 31A in the front-and-back position, the operating section 25A is not so far away from the pressing section 31A, the operator can securely reach the operating section 25A.

Then, pinching the plug connector 10 at the operating section 25A and the pressing section 31A, the operator press the operating section 25A to elastically flex to deform the elastic arm 23 and thereby release the lock, and lift the plug connector 10 straight backward and then pull out.

The disclosure of Japanese Patent Application No. 2009-280299, filed on Dec. 10, 2009 is incorporated in the application by reference.

While the invention has been explained with reference to the specific embodiments of the invention, the explanation is illustrative and the invention is limited only by the appended claims.

What is claimed is:

1. A plug electrical connector to be connected to a receptacle connector in a fitting direction, comprising:

a housing having a front face section and a back face section facing oppositely, said back face section including a pressing section; and an elastic arm extending from the front face section in the fitting direction, said elastic arm including a locking section for locking to the receptacle connector so that when an operative force is applied to the elastic arm and the pressing section, the elastic arm elastically deforms toward the back face section to release the locking section from the receptacle connector, wherein said elastic arm has a slanted section in an inclined shape away from the front face section, said slanted section including an operating section for receiving the operative force, said housing further includes a front face protrusion protruding from the front face section in a front-to-back direction that the elastic arm is elastically deformed, said front face protrusion including a protruding top portion situated at a position the same as that of the slanted section or protruding further than the slanted section in the front-to-back direction, and said operating section is arranged to protrude further than the locking section and be situated at a position the same as that of the front face protrusion in the front-to-back direction.

2. The plug electrical connector according to claim 1, wherein said front face protrusion is situated on both sides of the elastic arm.

3. The plug electrical connector according to claim 1, wherein said operating section is situated at a position the same as that of the protruding top portion or protrudes further than the protruding top portion in the front-to-back direction.

4. The plug electrical connector according to claim 1, wherein said housing further includes a back face protrusion protruding from the back face section, said back face protrusion including a pressing section.

5. The plug electrical connector according to claim 4, wherein said back face protrusion is arranged at a position corresponding to that of the front face protrusion in the front-to-back direction.

6. The plug electrical connector according to claim 1, wherein said front face protrusion is curved near the protruding top portion thereof toward the elastic arm.

7. The plug electrical connector according to claim 4, wherein said front face protrusion and said back face protrusion have push-in faces on rear surfaces thereof for receiving a press-in force applied in the fitting direction when the plug connector is connected to the receptacle connector.

8. The plug electrical connector according to claim 1, wherein said locking section includes a first locking section disposed on a left side of the operating section and a second locking section disposed on a right side of the operating section.

9. The plug electrical connector according to claim 1, wherein said elastic arm further includes a mortise portion at a middle of the slanted section.

10. The plug electrical connector according to claim 1, wherein said back face section further includes a lance for holding a terminal to be connected to the plug connector.

* * * * *